US009919193B2

(12) United States Patent
De Santis

(10) Patent No.: US 9,919,193 B2
(45) Date of Patent: Mar. 20, 2018

(54) PING PONG TABLE

(71) Applicant: Jared De Santis, Palisades Park, NJ (US)

(72) Inventor: Jared De Santis, Palisades Park, NJ (US)

( * ) Notice: Subject to any disclaimer, the term of this patent is extended or adjusted under 35 U.S.C. 154(b) by 11 days.

(21) Appl. No.: 15/144,150

(22) Filed: May 2, 2016

(65) Prior Publication Data

US 2017/0312605 A1 Nov. 2, 2017

(51) Int. Cl.
*A63B 67/04* (2006.01)
*A63B 69/00* (2006.01)

(52) U.S. Cl.
CPC ..... *A63B 67/04* (2013.01); *A63B 69/0097* (2013.01); *A63B 2225/09* (2013.01)

(58) Field of Classification Search
CPC ... A63B 67/04; A63B 67/045; A63B 69/0097; A63B 2225/09; A47B 25/003
USPC ..... D21/799.2
See application file for complete search history.

(56) References Cited

U.S. PATENT DOCUMENTS 2,313,701 A * 3/1943 White ..... A63B 67/04 473/475
2,643,924 A * 6/1953 Albano ..... A47B 1/04 108/77
3,567,222 A * 3/1971 Robins ..... A47B 25/003 473/435
3,738,653 A * 6/1973 Simpson ..... A63B 67/04 473/475
4,037,838 A * 7/1977 McCune ..... A63B 67/04 108/65
4,176,842 A * 12/1979 Zaldivar ..... A63F 7/0608 273/108.1
4,489,661 A * 12/1984 Fitzgerald ..... A47B 3/083 108/115
4,750,432 A * 6/1988 McNamara ..... A47B 31/04 108/69
4,762,321 A * 8/1988 Chang ..... A47B 25/003 108/115
4,765,619 A 8/1988 Cooper
5,398,926 A 3/1995 Skinner
5,566,936 A 10/1996 Newgarden et al.
5,575,471 A * 11/1996 Robinson ..... A63B 67/04 473/475
5,655,979 A * 8/1997 Blue ..... A63B 67/04 473/475
5,833,559 A * 11/1998 Appelbaum ..... A63B 67/04 473/496
D410,266 S * 5/1999 Beckham ..... D21/799.2
6,007,438 A 12/1999 Harrell
6,155,939 A 12/2000 Takacs
(Continued)

*Primary Examiner* — Raleigh W Chiu

(57) ABSTRACT

A ping pong table for playing ping pong on a variably configurable table includes a center panel that is rectangularly shaped. A pair of side panels is hingedly coupled singly to and extends from opposing sides of the center panel. The side panels extend between opposing ends of the center panel. A plurality of legs is coupled to and extends perpendicularly from a bottom of the center panel. The legs are positioned on the center panel such that the center panel is supportable on a substantially horizontal surface. The side panels are configured to be positioned in angled positions relative to the center panel.

18 Claims, 7 Drawing Sheets

(56) References Cited

U.S. PATENT DOCUMENTS

| | | | | |
|---|---|---|---|---|
| 6,729,982 | B1 * | 5/2004 | Appelbaum | A63B 67/002 108/11 |
| 6,939,256 | B2 | 9/2005 | Giacomoni | |
| 7,214,149 | B1 * | 5/2007 | Nowitzky | A63B 67/04 473/496 |
| 8,771,109 | B2 * | 7/2014 | Desender | A63B 67/04 473/490 |
| D724,686 | S | 3/2015 | Bonacina | |
| 2009/0176605 | A1 * | 7/2009 | Martinez Leon | A47B 3/0911 473/496 |
| 2013/0217521 | A1 * | 8/2013 | Santini | A47B 25/003 473/475 |
| 2014/0031149 | A1 * | 1/2014 | Liao | A47B 13/003 473/496 |
| 2014/0213393 | A1 * | 7/2014 | Chen | A47B 25/003 473/496 |

* cited by examiner

PING PONG TABLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to game tables and more particularly pertains to a new game table for playing ping pong on a variably configurable table.

BRIEF SUMMARY OF THE INVENTION

An embodiment of the disclosure meets the needs presented above by generally comprising a center panel that is rectangularly shaped. A pair of side panels is hingedly coupled singly to and extends from opposing sides of the center panel. The side panels extend between opposing ends of the center panel. A plurality of legs is coupled to and extends perpendicularly from a bottom of the center panel. The legs are positioned on the center panel such that the center panel is supportable on a substantially horizontal surface. The side panels are configured to be positioned in angled positions relative to the center panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
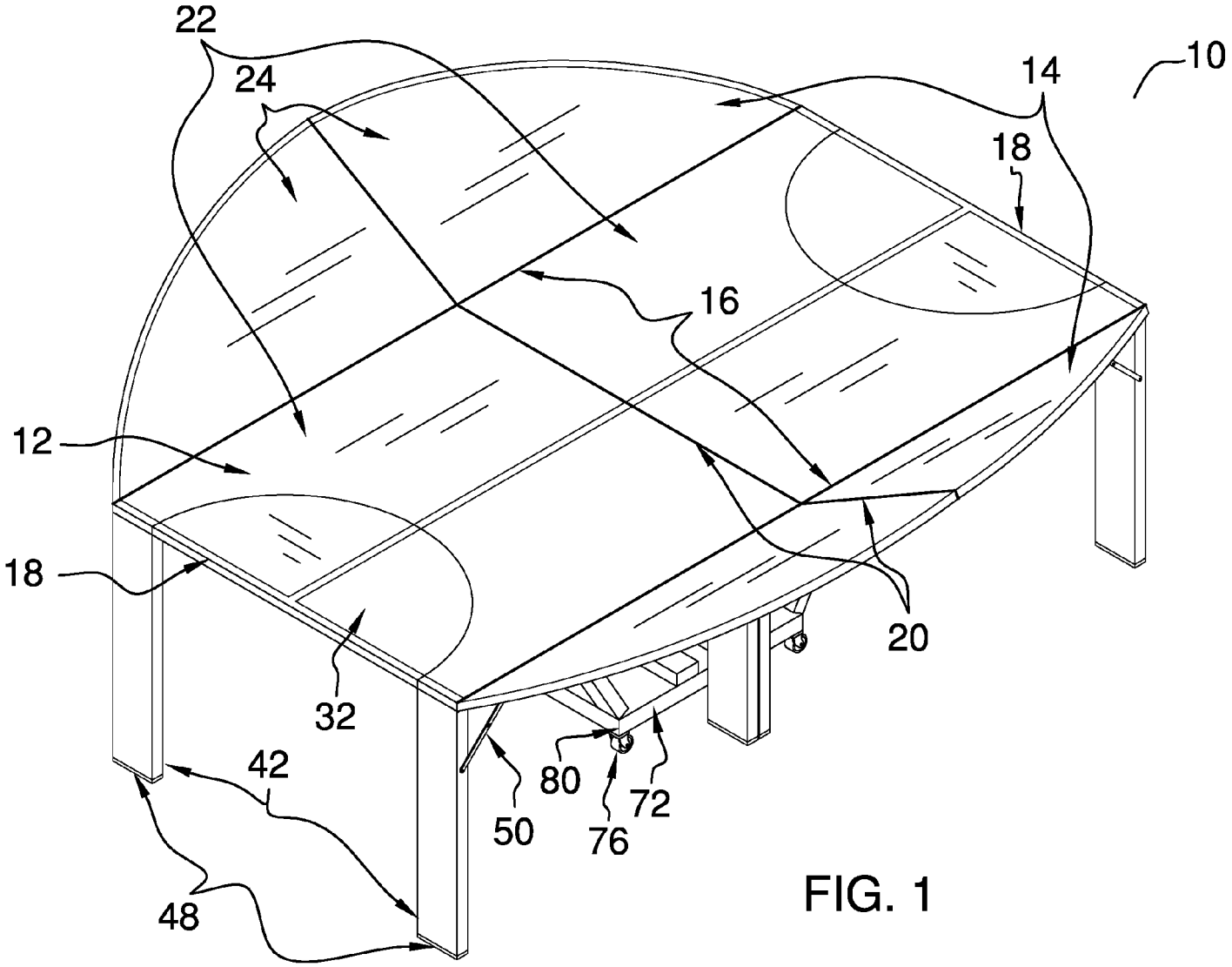
FIG. 1 is an isometric perspective view of a ping pong table according to an embodiment of the disclosure.
Figure 2:
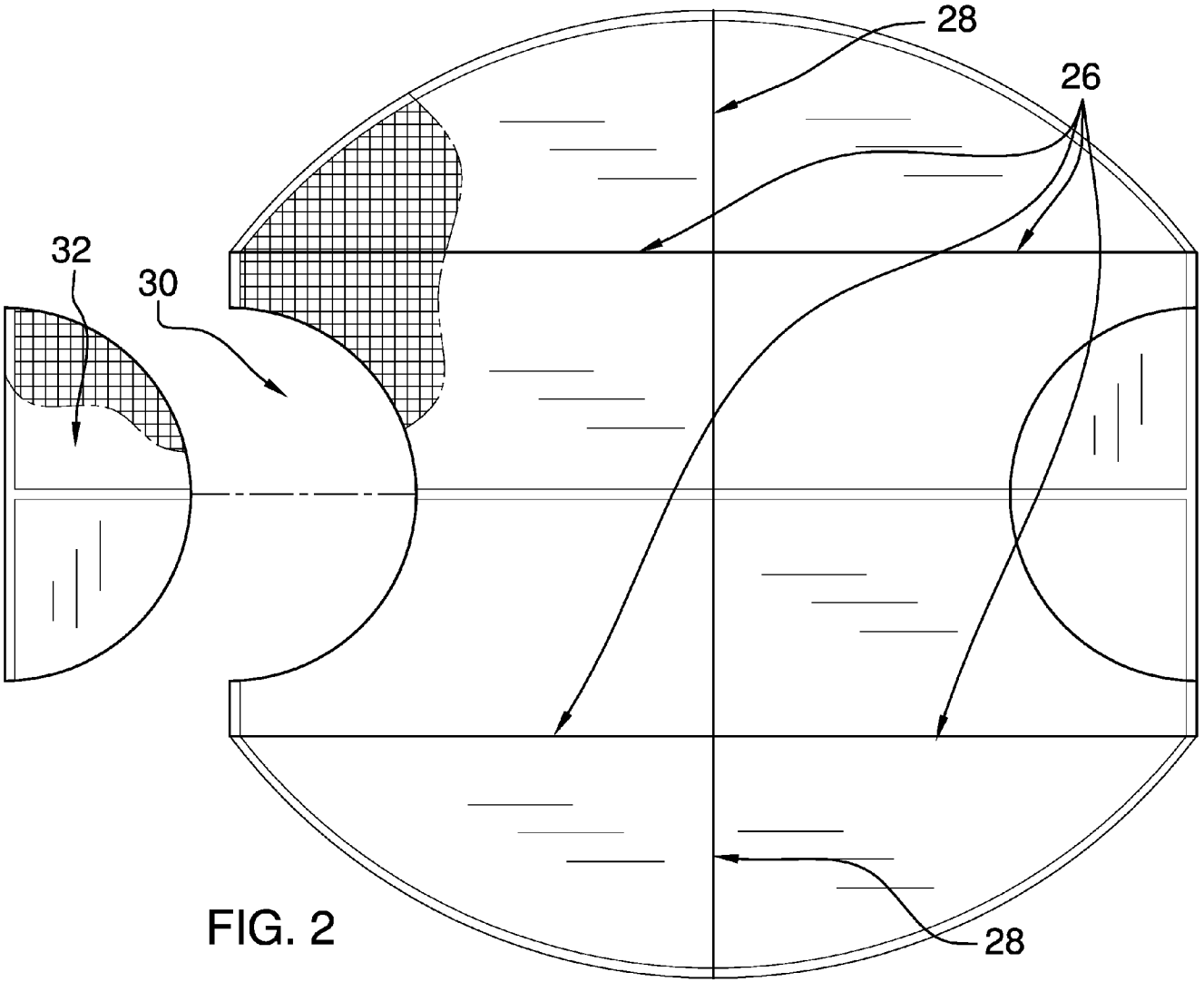
FIG. 2 is a top view of an embodiment of the disclosure.
Figure 3:
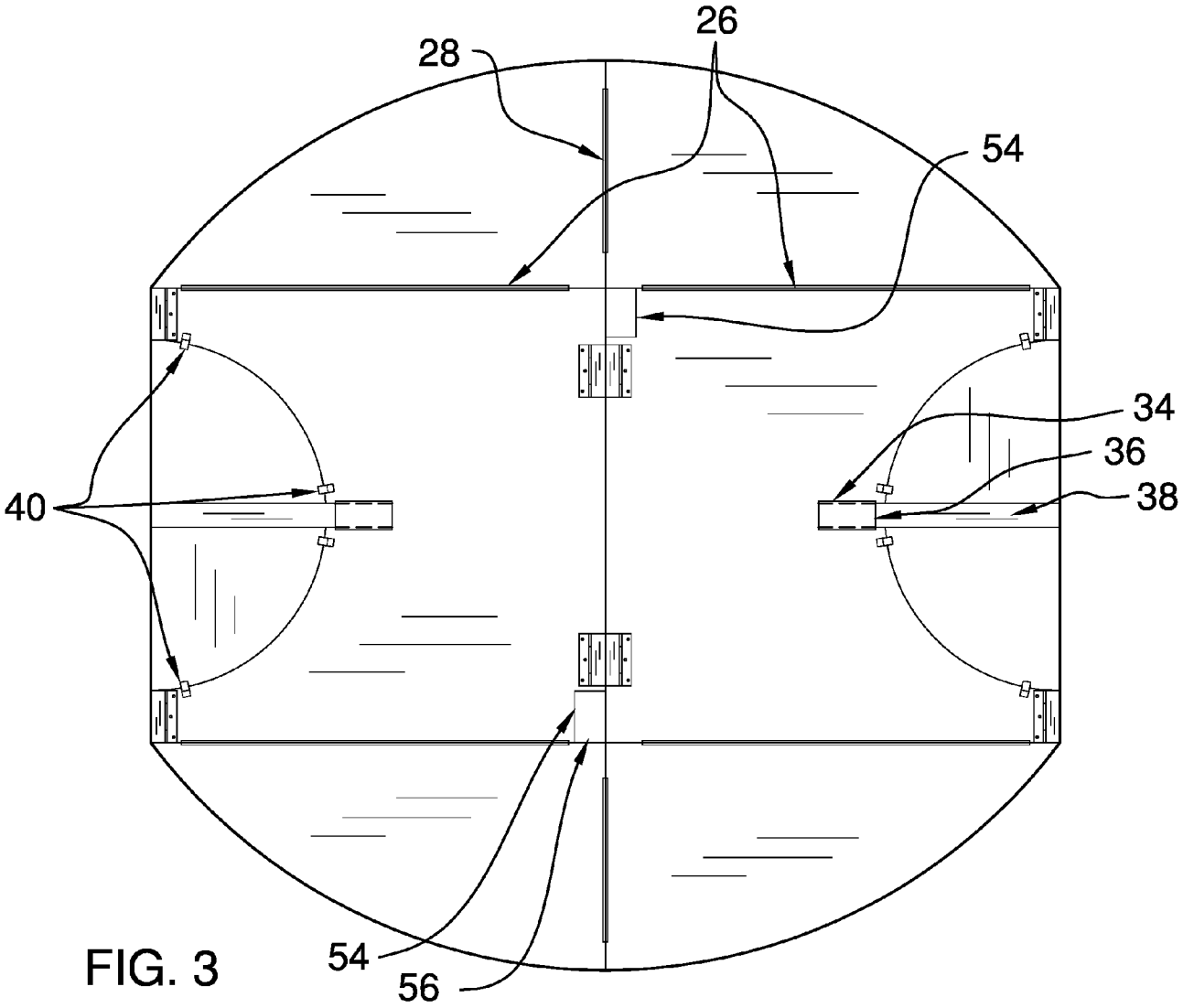
FIG. 3 is a bottom view of an embodiment of the disclosure.
Figure 4:
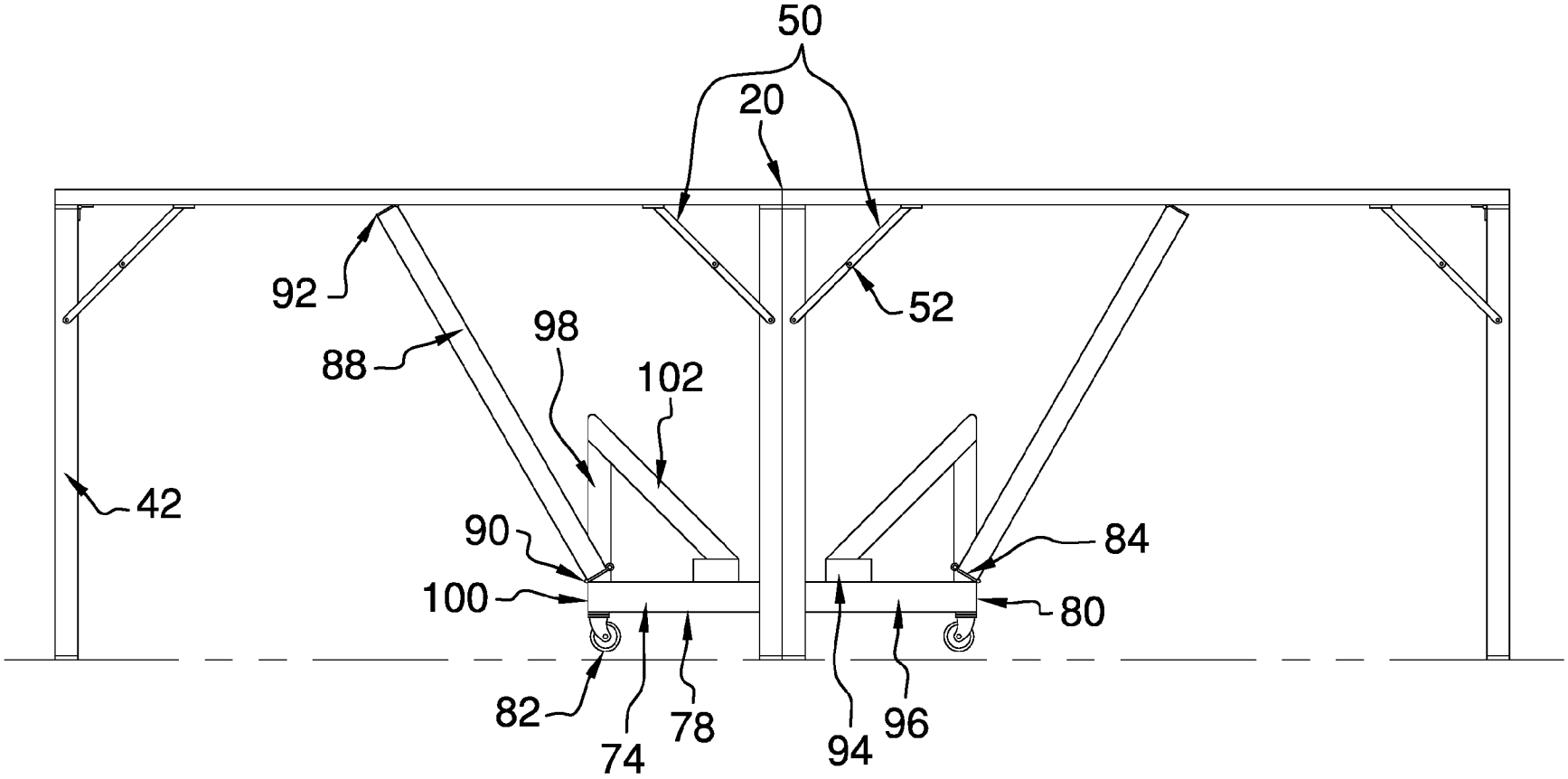
FIG. 4 is a side view of an embodiment of the disclosure.
Figure 5:
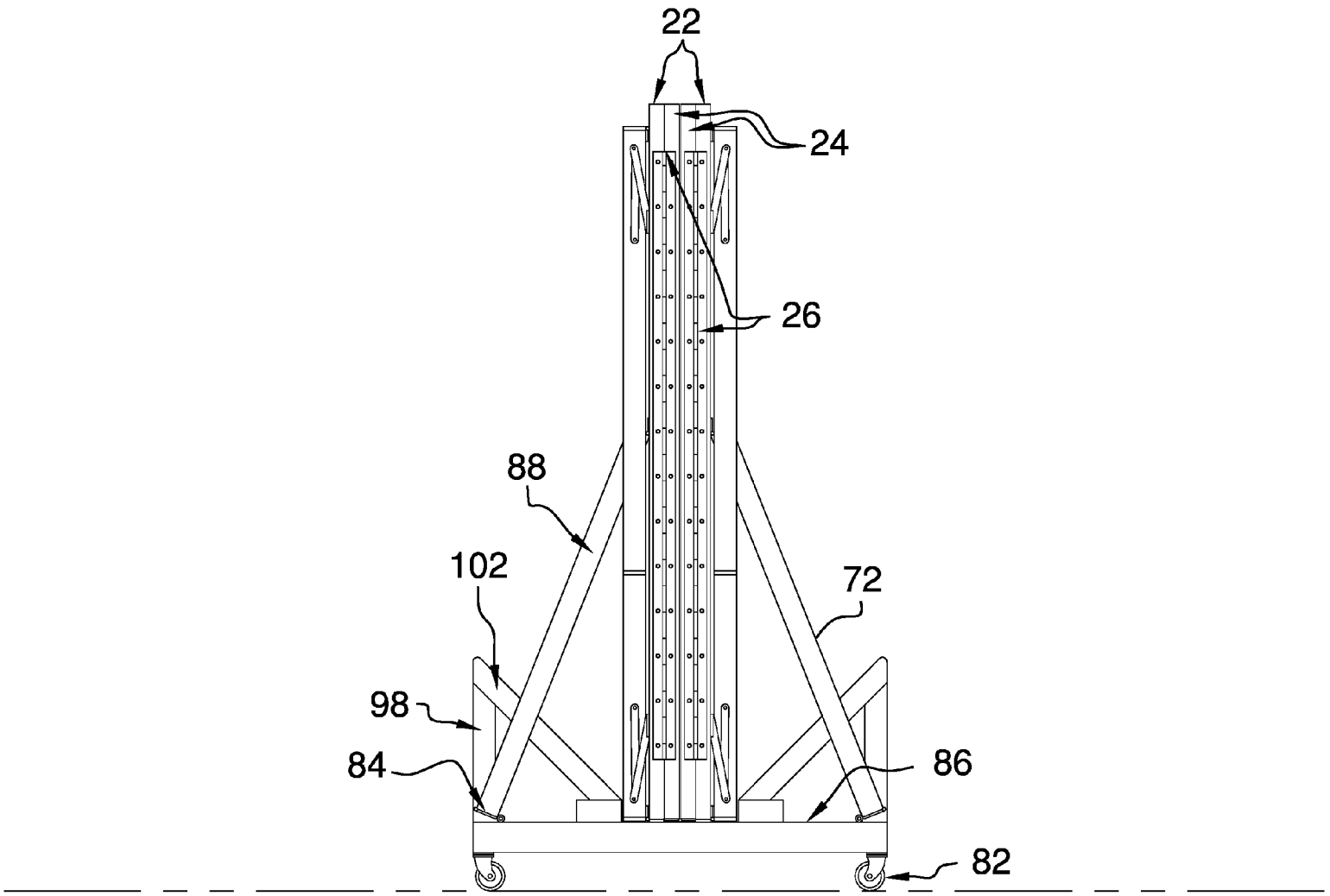
FIG. 5 is a side view of an embodiment of the disclosure.
Figure 6:
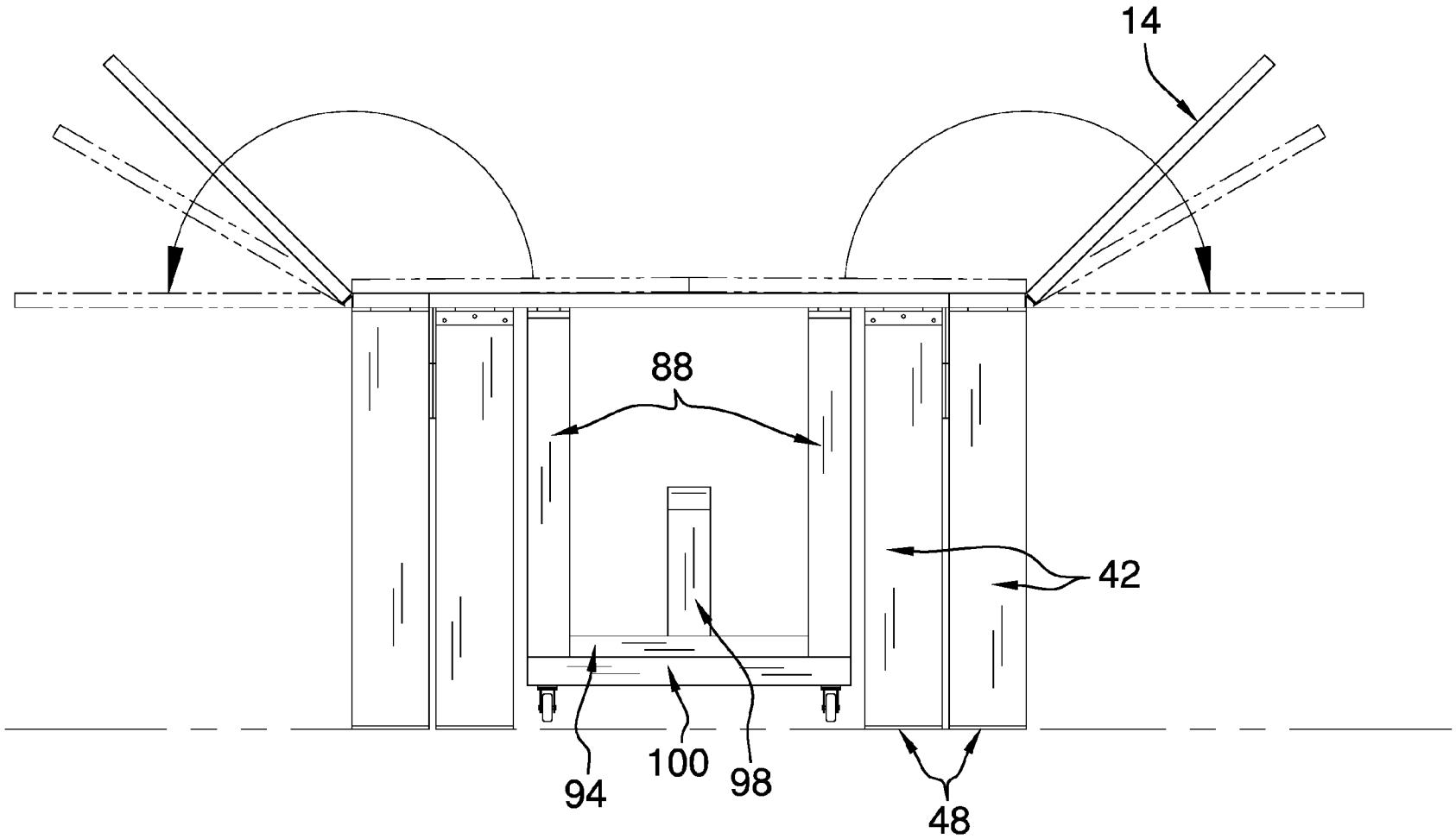
FIG. 6 is an end view of an embodiment of the disclosure.
Figure 7:
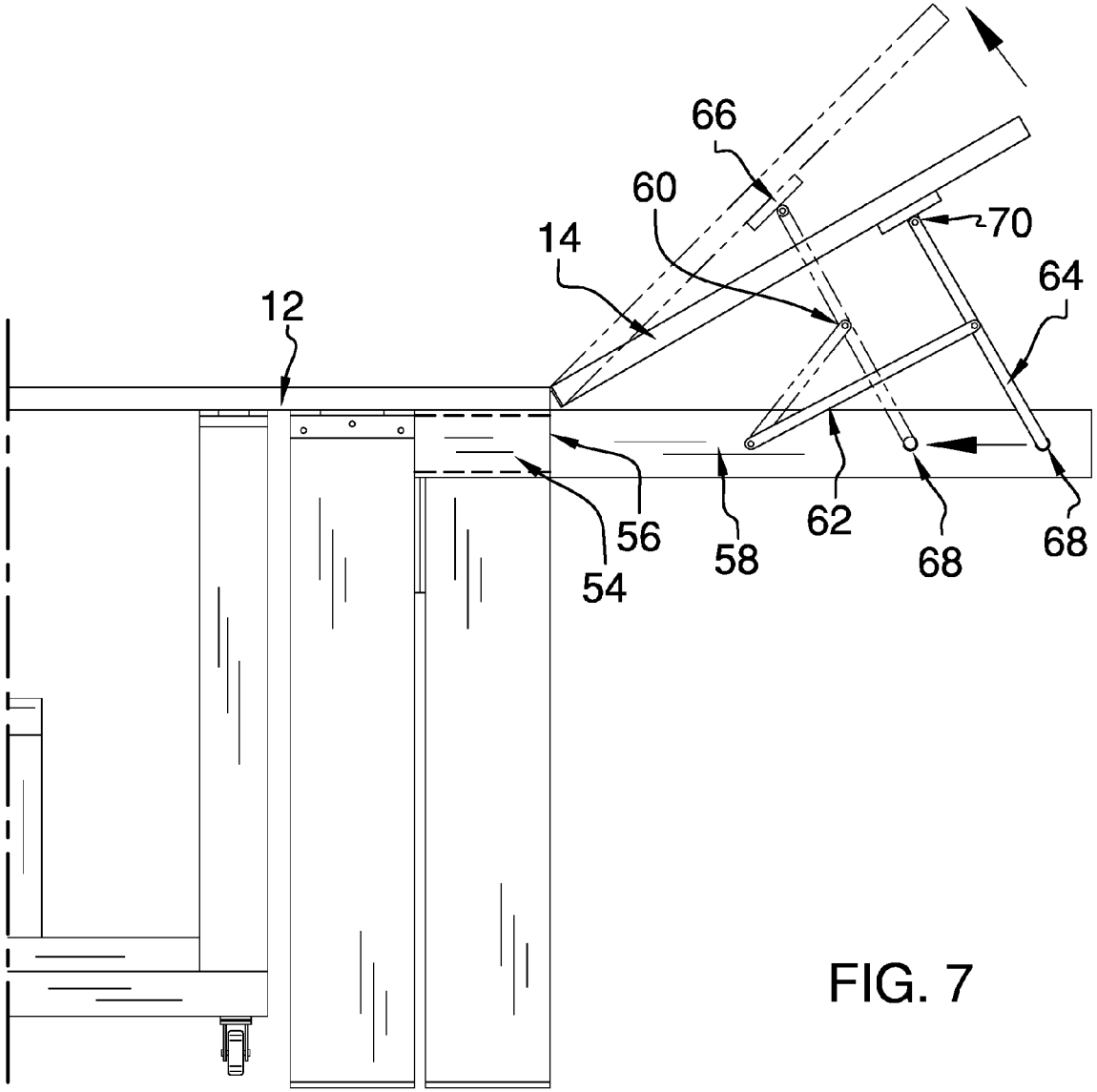
FIG. 7 is a detail view of an embodiment of the disclosure.

With reference now to the drawings, and in particular to FIGS. 1 through 7 thereof, a new game table embodying the principles and concepts of an embodiment of the disclosure and generally designated by the reference numeral 10 will be described.

As best illustrated in FIGS. 1 through 7, the ping pong table 10 generally comprises a center panel 12 that is rectangularly shaped. A pair of side panels 14 is hingedly coupled singly to and extends from opposing sides 16 of the center panel 12. The side panels 14 are configured to be positioned in angled positions relative to the center panel 12. The side panels 14 extend between opposing ends 18 of the center panel 12. The side panels 14 are arcuate.

A separation 20 is positioned equally distant from the opposing ends 18 of the center panel 12 and extends linearly through the side panels 14. The separation 20 is positioned such that the center panel 12 is divided into halves 22 and each side panel 14 is divided into equal sections 24.

Each of set of four first piano hinges 26 is coupled to a respective half 22 of the center panel 12 and a respective equal section 24 of a respective side panel 14. Each of a pair of second piano hinges 28 is positioned in a respective side panel 14 and coupled to the equal sections 24 of the respective side panel 14.

A pair of cutouts 30 is positioned singly in the center panel 12 adjacent to the opposing ends 18. The cutouts 30 are equally positioned between the opposing sides 16. The cutouts 30 are arcuate. A pair of inserts 32 is complementary to the cutouts 30. The inserts 32 are reversibly couplable to the center panel 12. Each insert 32 is positioned to couple to the center panel 12 to fill a respective cutout 30.

A pair of first brackets 34 is coupled singly to the center panel 12 proximate to each cutout 30. The first brackets 34 are substantially rectangularly box shaped. Each first bracket 34 has an open end 36 that faces a respective opposing end 18 of the center panel 12. A pair of first bars 38 is complementary to the first brackets 34. Each first bar 38 is configured to insert into the open end 36 of a respective first bracket 34. The first bar 38 is positioned to support a respective insert 32 within a respective cutout 30.

Each of a plurality of clips 40 is rotatably coupled to the center panel 12 adjacent to a respective cutout 30. Each clip 40 is positioned on the center panel 12 such that the clip 40 is configured to rotate. The clip 40 is positionable selectively under the center panel 12 and extending into a respective cutout 30 to support a respective insert 32. The plurality of clips 40 comprises eight clips 40 positioned four each proximate to each cutout 30.

A plurality of legs 42 is coupled to and extends perpendicularly from a bottom 44 of the center panel 12. The legs 42 are hingedly coupled to the center panel 12. Each leg 42 is foldable to substantial parallelism with the center panel 12. The plurality of legs 42 comprises eight legs 42 that are coupled singly proximate to each corner 46 of each half 22 of the center panel 12. Respective legs 42 that are coupled proximate to the opposing ends 18, when folded, are positioned adjacent to respective opposing sides 16 of the center panel 12. Respective legs 42 that are coupled proximate to the separation 20, when folded, are positioned adjacent to the respective legs 42 coupled proximate to the opposing ends 18.

Each of a plurality of feet 48 is coupled to a respective leg 42 distal from the center panel 12. The feet 48 are positioned on the legs 42 such that the feet 48 are configured to contact the substantially horizontal surface. The feet 48 comprise rubber.

Each of a plurality of stiffeners 50 is pivotally coupled to and extends between a respective leg 42 and the center panel 12. Each stiffener 50 comprises a central pivot 52. Each stiffener 50 is configured linearly when the legs 42 are pivoted away from the center panel 12. The central pivots 52 are positioned in the stiffeners 50 such that the stiffeners 50 are configured to fold as the legs 42 are pivoted toward the center panel 12.

A pair of second brackets 54 is coupled singly to the center panel 12 proximate to each opposing side 16 of the center panel 12. The second brackets 54 are substantially rectangularly box shaped. Each second bracket 54 has an open face 56 that is positioned adjacent to a respective opposing side 16 of the center panel 12. A pair of second bars 58 is complementary to the second brackets 54. Each second bar 58 is configured to insert 32 into the open face 56 of a respective second bracket 54.

Each of a pair of wing supports 60 comprises a first rod 62, a second rod 64 and a rubber pad 66. The first rod 62 is pivotally coupled to a respective second bar 58. The second rod 64 has a first terminus 68 and a second terminus 70. The first rod 62 is pivotally coupled to the second rod 64 distal from the respective second bar 58 and substantially equally distant from the first terminus 68 and the second terminus 70. The first terminus 68 is selectively and reversibly couplable to the respective second bar 58. The rubber pad 66 is pivotally coupled to the second terminus 70 of the second rod 64. The first terminus 68 is selectively and reversibly couplable to the respective second bar 58, such that a respective wing support 60 is positioned between the respective second bar 58 and a respective side panel 14, supporting the respective side panel 14 at an angle to the center panel 12.

A storage cart 72 is hingedly coupled to the bottom 44 of the center panel 12. The storage cart 72 is positioned to support the center panel 12, the side panel 14 and the legs 42 in a folded configuration. The storage cart 72 comprises a base 74 that is rectangularly shaped. Each of a set of four rollers 76 is coupled to an underside 78 of the base 74 proximate to a respective corner edge 80 of the base 74. The rollers 76 comprise castors 82.

Each of a set of four double hinges 84 is coupled to a topside 86 of the base 74 proximate to the respective corner edge 80 of the base 74. Each of a set of four posts 88 has a bottom end 90 that is coupled to a respective double hinge 84. Each post 88 has a top end 92 that is hingedly coupled to a respective half 22 of the center panel 12 substantially equally distant from the separation 20 and the respective opposing end 18 of the center panel 12. The posts 88 are positioned to pivot as the center panel 12 is lifted at the opposing ends 18.

A pair of cross supports 94 is coupled to the topside 86 of the base 74. The cross supports 94 extend between opposing side edges 96 of the base 74. Each of a pair of verticals 98 is coupled to and extends perpendicularly from the topside 86 of the base 74. Each vertical 98 is positioned on a respective opposing end edge 100 of the base 74 substantially equally distant form the opposing side edges 96 of the base 74. Each of a pair of angle arms 102 is coupled to and extends between a respective vertical 98 distal from the topside 86 and a respective cross support 94.

In use the legs 42 are positioned on the center panel 12 such that the center panel 12 is supportable on a substantially horizontal surface. The first terminus 68 of the second rod 64 is selectively and reversibly couplable to the respective second bar 58 such that the respective wing support 60 is positioned between the respective second bar 58 and the respective side panel 14, supporting the respective side panel 14 at an angle to the center panel 12. The first piano hinges 26 and the second piano hinges 28 are positioned on the equal sections 24 of the side panels 14 such that the side panels 14 are foldable onto the center panel 12. The center panel 12 and the side panels 14 are foldable along the separation 20. The legs 42 are foldable against the center panel 12, such that the legs 42, the center panel 12 and the side panels 14 are positioned to stow on the storage cart 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ping pong table comprising:

a center panel, said center panel being rectangularly shaped;

a pair of side panels hingedly coupled singly to and extending from opposing sides of said center panel, said side panels extending between opposing ends of said center panel;

a plurality of legs coupled to and extending perpendicularly from a bottom of said center panel; and wherein said legs are positioned on said center panel such that said center panel is supportable on a substantially horizontal surface, wherein said side panels are configured to be positioned in angled positions relative to said center panel;

a pair of cutouts positioned singly in said center panel adjacent to said opposing ends, said cutouts being equally positioned between said opposing sides, said cutouts being arcuate; and a pair of inserts, said inserts being complementary to said cutouts, said inserts being reversibly couplable to said center panel, wherein each said insert is positioned to couple to said center panel to fill a respective said cutout.

2. The table of claim 1, further including said side panels being arcuate.

3. The table of claim 1, further comprising:

a pair of first brackets coupled singly to said center panel proximate to each said cutout, said first brackets being substantially rectangularly box shaped, each said first bracket having an open end facing a respective said opposing end of said center panel; and a pair of first bars complementary to said first brackets, wherein each said first bar is configured to insert into said open end of a respective said first bracket, such that said first bar is positioned to support a respective said insert within a respective said cutout.

4. The table of claim 3, further comprising:

a pair of second brackets coupled singly to said center panel proximate to said opposing sides of said center panel, said second brackets being substantially rectangularly box shaped, each said second bracket having an open face positioned adjacent to said respective said opposing side of said center panel;

a pair of second bars complementary to said second brackets, wherein each said second bar is configured to insert into said open face of a respective said second bracket;

a pair of wing supports, each said wing support comprising:

a first rod pivotally coupled to a respective said second bar, a second rod having a first terminus and a second terminus, said first rod being pivotally coupled to said second rod distal from said respective said second bar and substantially equally distant from said first terminus and said second terminus, said first terminus being selectively and reversibly couplable to said respective said second bar, and a rubber pad pivotally coupled to said second terminus of said second rod; and wherein said first terminus is selectively and reversibly couplable to said respective said second bar such that a respective said wing support is positioned between said respective said second bar and a respective said side panel supporting said respective said side panel at an angle to said center panel.

5. The table of claim 1, further including a plurality of clips, each said clip being rotatably coupled to said center panel adjacent to a respective cutout, wherein each said clip is positioned on said center panel such that said clip is configured for rotation, wherein said clip is selectively positionable under said center panel and extending into a respective said cutout to support a respective said insert.

6. The table of claim 5, further including said plurality of clips comprising eight said clips positioned four each proximate to each said cutout.

7. The table of claim 1, further including a plurality of feet, each said foot being coupled to a respective said leg distal from said center panel, wherein said feet are positioned on said legs such that said feet are configured to contact the substantially horizontal surface.

8. The table of claim 7, further including said feet comprising rubber.

9. A ping pong table comprising:

a center panel, said center panel being rectangularly shaped;

a pair of side panels hingedly coupled singly to and extending from opposing sides of said center panel, said side panels extending between opposing ends of said center panel;

a plurality of legs coupled to and extending perpendicularly from a bottom of said center panel;

wherein said legs are positioned on said center panel such that said center panel is supportable on a substantially horizontal surface, wherein said side panels are configured to be positioned in angled positions relative to said center panel;

a separation positioned equally distant from said opposing ends of said center panel and extending linearly through said side panels, wherein said separation is positioned such that said center panel is divided into halves and each said side panel is divided into equal sections;

a set of four first piano hinges, each said first piano hinge being coupled to a respective said half of said center panel and a respective said equal section of a respective said side panel; and a pair of second piano hinges, each said second piano hinge being positioned in a respective said side panel and coupled to said equal sections of said respective said side panel.

10. The table of claim 9, further including said legs being hingedly coupled to said center panel, wherein each said leg is foldable to substantial parallelism with said center panel.

11. The table of claim 10, further including said plurality of legs comprising eight legs coupled singly proximate to each corner of each said half of said center panel, wherein respective said legs coupled proximate to said opposing ends are positioned adjacent to respective said opposing sides of said center panel when folded, and wherein respective said legs coupled proximate to said separation are positioned adjacent to said respective said legs coupled proximate to said opposing ends when said respective said legs coupled proximate to said separation are folded.

12. The table of claim 11, further including a plurality of stiffeners, each said stiffener being pivotally coupled to and extending between a respective said leg and said center panel, each said, stiffener comprising a central pivot, wherein each said stiffener is configured linearly when said legs are pivoted away from said center panel, and wherein said central pivots are positioned in said stiffeners such that said stiffeners are configured to fold as said legs are pivoted toward said center panel.

13. The table of claim 10, further including a storage cart hingedly coupled to said bottom of said center panel, wherein said storage cart is positioned to support said center panel, said side panel and said legs in a folded configuration.

14. The table of claim 13, further including said storage cart comprising:

a base, said base being rectangularly shaped;

a set of four rollers, each said roller being coupled to an underside of said base proximate to a respective corner edge of said base;

a set of four double hinges, each said double hinge being coupled to a topside of said base proximate to said respective said corner edge of said base;

a set of four posts, each said post having a bottom end coupled to a respective said double hinge, each said post having a top end hingedly coupled to a respective said half of said center panel substantially equally distant from said separation and said respective said opposing end of said center panel; and wherein said posts are positioned to pivot as said center panel is lifted at said opposing ends.

15. The table of claim 14, further including said rollers comprising castors.

16. The table of claim 14, further including a pair of cross supports coupled to said topside of said base, said cross supports extending between opposing side edges of said base.

17. The table of claim 16, further comprising:

a pair of verticals, each said vertical being coupled to and extending perpendicularly from said topside of said base, each said vertical being positioned on a respective opposing end edge of said base substantially equally distant form said opposing side edges of said base; and a pair of angle arms, each said angle arm being coupled to and extending between a respective said vertical distal from said top side and a respective said cross support.

18. A ping pong table comprising:

a center panel, said center panel being rectangularly shaped;

a pair of side panels hingedly coupled singly to and extending from opposing sides of said center panel, wherein said side panels are configured to be positioned in angled positions relative to said center panel, said side panels extending between opposing ends of said center panel, said side panels being arcuate;

a separation positioned equally distant from said opposing ends of said center panel and extending linearly through said side panels, wherein said separation is positioned such that said center panel is divided into halves and each said side panel is divided into equal sections;

a set of four first piano hinges, each said first piano hinge being coupled to a respective said half of said center panel and a respective said equal section of a respective said side panel;

a pair of second piano hinges, each said second piano hinge being positioned in a respective said side panel and coupled to said equal sections of said respective said side panel;

a pair of cutouts positioned singly in said center panel adjacent to said opposing ends, said cutouts being equally positioned between said opposing sides, said cutouts being arcuate;

a pair of inserts, said inserts being complementary to said cutouts, said inserts being reversibly couplable to said center panel, wherein each said insert is positioned to couple to said center panel to fill a respective said cutout;

a pair of first brackets coupled singly to said center panel proximate to each said cutout, said first brackets being substantially rectangularly box shaped, each said first bracket having an open end facing a respective said opposing end of said center panel;

a pair of first bars complementary to said first brackets, wherein each said first bar is configured to insert into said open end of a respective said first bracket, such that said first bar is positioned to support a respective said insert within a respective said cutout;

a plurality of clips, each said clip being rotatably coupled to said center panel adjacent to a respective cutout, wherein each said clip is positioned on said center panel such that said clip is configured for rotation, wherein said clip is selectively positionable under said center panel and extending into a respective said cutout to support a respective said insert, said plurality of clips comprising eight said clips positioned four each proximate to each said cutout;

a plurality of legs coupled to and extending perpendicularly from a bottom of said center panel, said legs being hingedly coupled to said center panel, wherein each said leg is foldable to substantial parallelism with said center panel, said plurality of legs comprising eight legs coupled singly proximate to each corner of each said half of said center panel, wherein respective said legs coupled proximate to said opposing ends are positioned adjacent to respective said opposing sides of said center panel when folded, and wherein respective said legs coupled proximate to said separation are positioned adjacent to said respective said legs coupled proximate to said opposing ends when said respective said legs coupled proximate to said separation are folded;

a plurality of feet, each said foot being coupled to a respective said leg distal from said center panel, wherein said feet are positioned on said legs such that said feet are configured to contact the substantially horizontal surface, said feet comprising rubber;

a plurality of stiffeners, each said stiffener being pivotally coupled to and extending between a respective said leg and said center panel, each said, stiffener comprising a central pivot, wherein each said stiffener is configured linearly when said legs are pivoted away from said center panel, and wherein said central pivots are positioned in said stiffeners such that said stiffeners are configured to fold as said legs are pivoted toward said center panel;

a pair of second brackets coupled singly to said center panel proximate to said opposing sides of said center panel, said second brackets being substantially rectangularly box shaped, each said second bracket having an open face positioned adjacent to said respective said opposing side of said center panel;

a pair of second bars complementary to said second brackets, wherein each said second bar is configured to insert into said open face of a respective said second bracket;

a pair of wing supports, each said wing support comprising:

a first rod pivotally coupled to a respective said second bar, a second rod having a first terminus and a second terminus, said first rod being pivotally coupled to said second rod distal from said respective said second bar and substantially equally distant from said first terminus and said second terminus, said first terminus being selectively and reversibly couplable to said respective said second bar, a rubber pad pivotally coupled to said second terminus of said second rod, and wherein said first terminus is selectively and reversibly couplable to said respective said second bar such that a respective said wing support is positioned between said respective said second bar and a respective said side panel supporting said respective said side panel at an angle to said center panel;

a storage cart hingedly coupled to said bottom of said center panel, wherein said storage cart is positioned to support said center panel, said side panel and said legs in a folded configuration, said storage cart comprising:

a base, said base being rectangularly shaped, a set of four rollers, each said roller being coupled to an underside of said base proximate to a respective corner edge of said base, said rollers comprising castors, a set of four double hinges, each said double hinge being coupled to a topside of said base proximate to said respective said corner edge of said base, a set of four posts, each said post having a bottom end coupled to a respective said double hinge, each said post having a top end hingedly coupled to a respective said half of said center panel substantially equally distant from said separation and said respective said opposing end of said center panel, wherein said posts are positioned to pivot as said center panel is lifted at said opposing ends, a pair of cross supports coupled to said topside of said base, said cross supports extending between opposing side edges of said base, a pair of verticals, each said vertical being coupled to and extending perpendicularly from said topside of said base, each said vertical being positioned on a respective opposing end edge of said base substantially equally distant form said opposing side edges of said base, and a pair of angle arms, each said angle arm being coupled to and extending between a respective said vertical distal from said top side and a respective said cross support;

wherein said legs are positioned on said center panel such that said center panel is supportable on a substantially horizontal surface, wherein said first terminus is selectively and reversibly couplable to said respective said second bar such that said respective said wing support is positioned between said respective said second bar and said respective said side panel supporting said respective said side panel at an angle to said center panel, wherein said first piano hinges and said second piano hinges are positioned on said equal sections of said side panels such that said side panels are foldable onto said center panel, wherein said center panel and said side panels are foldable along said separation, wherein said legs are foldable against said center panel, such that said legs, said center panel and said side panels are positioned for stowing on said storage cart.

* * * * *